US007276674B2

(12) United States Patent
Cao et al.

(10) Patent No.: US 7,276,674 B2
(45) Date of Patent: Oct. 2, 2007

(54) COMPONENT FOR AN IMAGE FORMING APPARATUS WITH DESIGNED THERMAL RESPONSE

(75) Inventors: Jichang Cao, Lexington, KY (US); Stephen Francis DeFosse, Lexington, KY (US); Hrishikesh Pramod Gogate, Lexington, KY (US); Edward Lawrence Kiely, Lexington, KY (US); Michael David Maul, Lexington, KY (US); Ganesh Vinayak Phatak, Lexington, KY (US); Jerry Wayne Smith, Irvine, KY (US)

(73) Assignee: Lexmark International, Inc., Lexington, KY (US)

( * ) Notice: Subject to any disclaimer, the term of this patent is extended or adjusted under 35 U.S.C. 154(b) by 32 days.

(21) Appl. No.: 11/327,863

(22) Filed: Jan. 9, 2006

(65) Prior Publication Data

US 2007/0158325 A1 Jul. 12, 2007

(51) Int. Cl.
*G03G 15/20* (2006.01)

(52) U.S. Cl. ..... 219/216; 399/333

(58) Field of Classification Search ..... None
See application file for complete search history.

(56) References Cited

U.S. PATENT DOCUMENTS 4,109,135 A 8/1978 Minden et al.
4,127,764 A 11/1978 Minden
4,533,231 A * 8/1985 Shigenobu ..... 399/331
4,627,813 A 12/1986 Sasaki
4,942,434 A 7/1990 Nakai et al.
4,949,130 A 8/1990 Torino
5,023,464 A 6/1991 Mitsuya et al.
5,291,257 A 3/1994 Cerrah et al.
5,659,868 A 8/1997 Fromm et al.
5,724,638 A 3/1998 Isogai et al.
5,839,042 A 11/1998 Tomatsu
5,999,788 A 12/1999 Kanesawa et al.
6,002,106 A * 12/1999 Kataoka et al. ..... 219/216
6,037,092 A 3/2000 Heeks et al.
6,085,058 A * 7/2000 Goto et al. ..... 399/313
6,159,588 A 12/2000 Eddy et al.
6,183,869 B1 2/2001 Okuda et al.
6,365,280 B1 4/2002 Schlueter, Jr. et al.
6,408,160 B1 6/2002 Saito et al.
6,459,878 B1 * 10/2002 Tomoyuki et al. ..... 399/331
6,479,158 B1 11/2002 Kuntz et al.
6,490,429 B2 12/2002 Okayasu et al.
6,577,837 B2 6/2003 Iida et al.
6,658,230 B2 12/2003 Satoh
6,792,240 B2 * 9/2004 Shida et al. ..... 399/333
6,898,388 B2 5/2005 Uehara et al.
6,944,419 B2 * 9/2005 Kawamoto et al. ..... 399/327
2002/0031383 A1 * 3/2002 Saito et al. ..... 399/333
2003/0185603 A1 * 10/2003 Takagi et al. ..... 399/329
2004/0192528 A1 * 9/2004 Fukase et al. ..... 492/53

FOREIGN PATENT DOCUMENTS

JP 2003-223969 A * 8/2003

* cited by examiner

*Primary Examiner*—J. Pelham
(74) *Attorney, Agent, or Firm*—Grossman, Tucker, Perreaul & Pfleger, PLLC

(57) ABSTRACT

The present invention provides a component that exhibits a designed thermal response which may be used in an image forming apparatus. The component may include a roller that contacts a heating device such as a fuser.

22 Claims, 3 Drawing Sheets

COMPONENT FOR AN IMAGE FORMING APPARATUS WITH DESIGNED THERMAL RESPONSE

FIELD OF INVENTION

The present invention relates to a component for use in an image forming apparatus that has a designed thermal response, such as a relatively low thermal response when exposed to heat. An image forming apparatus may include inkjet printers, electrophotographic printers, copiers, faxes, multifunctional devices or all-in-one devices. The low thermal response component may be used in combination with heating devices, such as a fuser.

BACKGROUND

An image forming apparatus may incorporate a fixing device, such as a fuser, for fixing toner or other image forming substances to media. The fixing device may include a heating device, for example, a belt fusing system or a hot roll system, which applies heat and/or pressure to the image fixing substance on the media. The fixing device may also include a roller in cooperation with the heating device to form a nip through which the media passes. The roller may contact the heating device either directly or indirectly, through contact with the media, creating an additional thermal load on the heating device. The roller may or may not drive the media through the nip.

SUMMARY

In a first exemplary embodiment, the present invention is directed at a component which is capable of engaging a heating source in an image forming apparatus. The component includes a metallic material have a thermal response ($TR_1$) and a non-metallic material having a thermal response ($TR_2$), wherein $TR_1+TR_2$ is less than or equal to about 130 J/K. The thermal mass of the non-metallic material may also be less than the thermal mass of the metallic material.

In a second exemplary embodiment, the present invention is directed at a roller that is capable of engaging a fuser in an image forming apparatus. The roller may include a metallic shaft having a thermal response ($TR_1$) and a non-metallic core having a thermal response ($TR_2$) wherein $TR_1+TR_2$ is less than or equal to about 130 J/K.

BRIEF DESCRIPTION OF DRAWINGS

The detailed description below may be better understood with reference to the accompanying figures which are provided for illustrative purposes and are not to be considered as limiting any aspect of the invention.

DETAILED DESCRIPTION

The present invention relates to a component for use in an image forming apparatus that has a designed thermal response, such as a relatively low thermal response when exposed to heat. The image forming apparatus may include printers, copiers, faxes, multifunctional devices or all-in-one devices. An image forming apparatus may incorporate a fixing device, such as a fuser, or another device which may transfer heat or thermal energy within the image forming apparatus.

Figure 1:
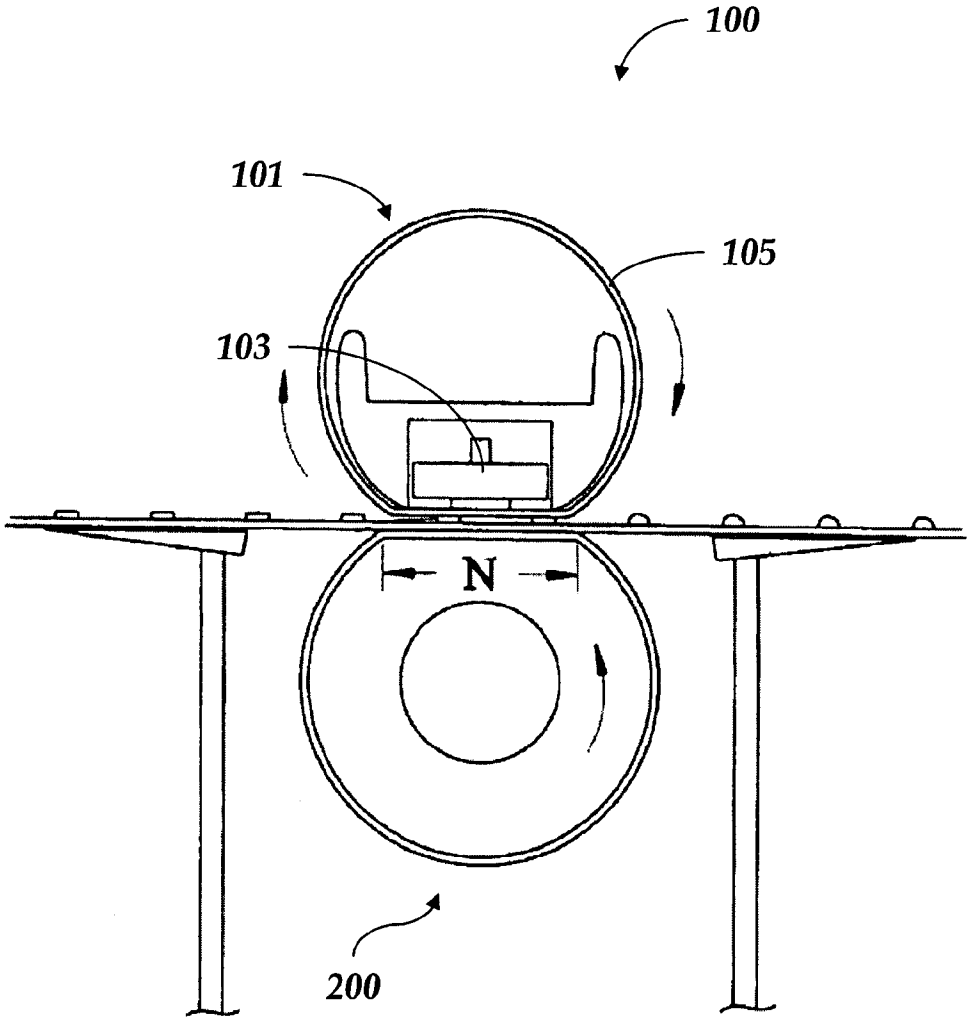
FIG. 1 is a side view of an exemplary embodiment of the present invention of a fixing device that may be located within an image forming apparatus.

FIG. 1 therefore illustrates an exemplary fixing device or fuser 100. The fixing device may be used to fix toner or other image forming substances to media through the application of heat and/or pressure. The fixing device may specifically include a heating device 101. The heating device may be a heating element 103 with a flexible belt or film 105 that may rotate about the heating element 103. Although not illustrated, the heating device may also include a roller incorporating a heating element. Heating elements may include, for example, ceramic heating elements or heating lamps.

A component 200 may be used in combination with the heating device 101. The component 200 may be a roller or platen. A nip "N" may be formed between the heating device 101 and the roller 200 through which media may pass. The roller 200 may be engaged in a contacting relationship with the heating device 101, either by direct contact or by indirect contact through a piece of media. Such roller may be understood as a back-up roller (BUR). A nip pressure may be formed between the heating device 101 and the roller 200. The nip pressure may be between 5 psi to 30 psi and any increment or value therebetween, such as 20 psi, 21 psi, etc. Furthermore, the roller 200 engaged with the heating device 101 may be heated by the heating device 101 and may therefore increase the thermal load on the heating device 101.

Figure 2:
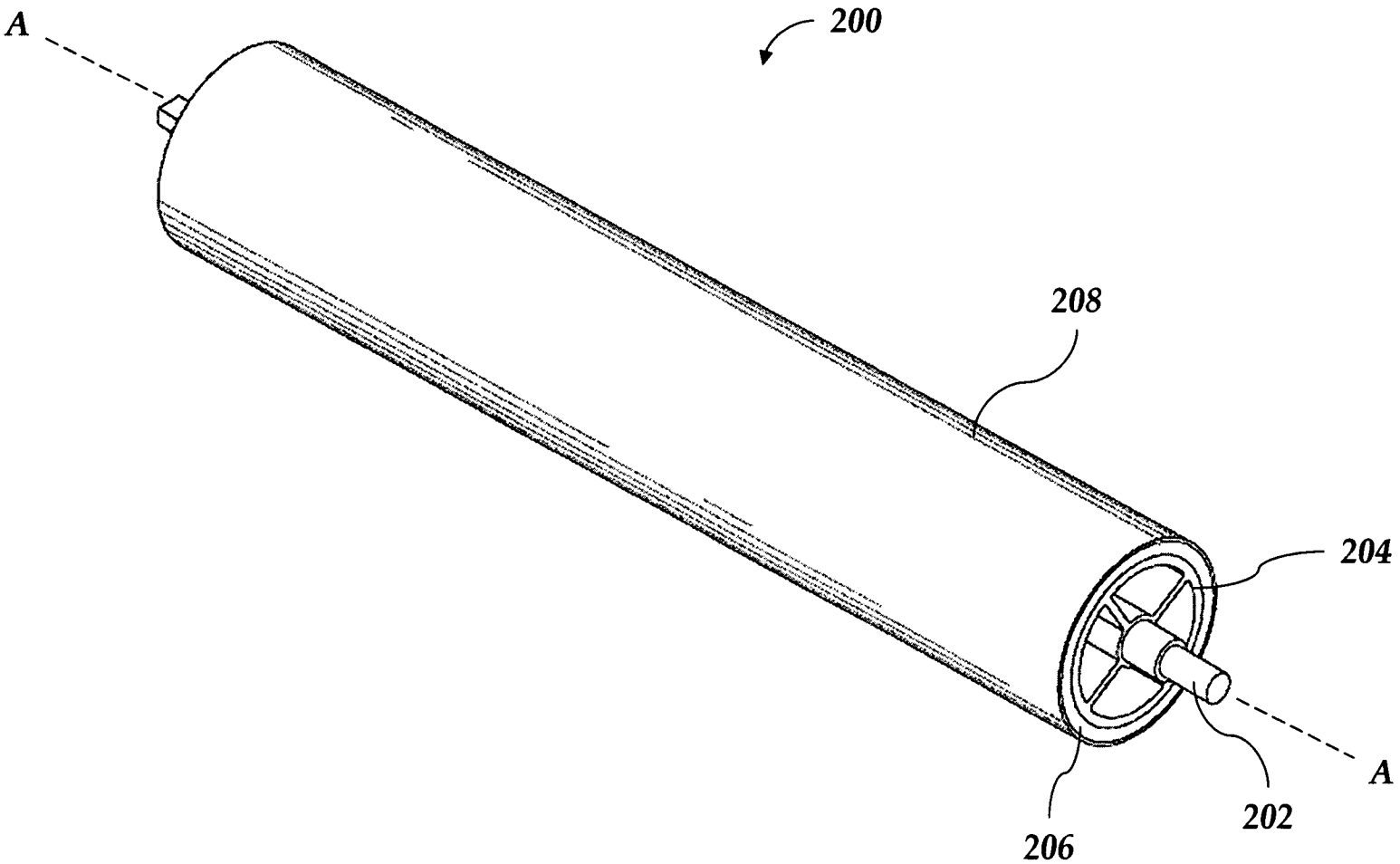
FIG. 2 is a perspective view of an illustration of an exemplary embodiment of a component.
Figure 3:
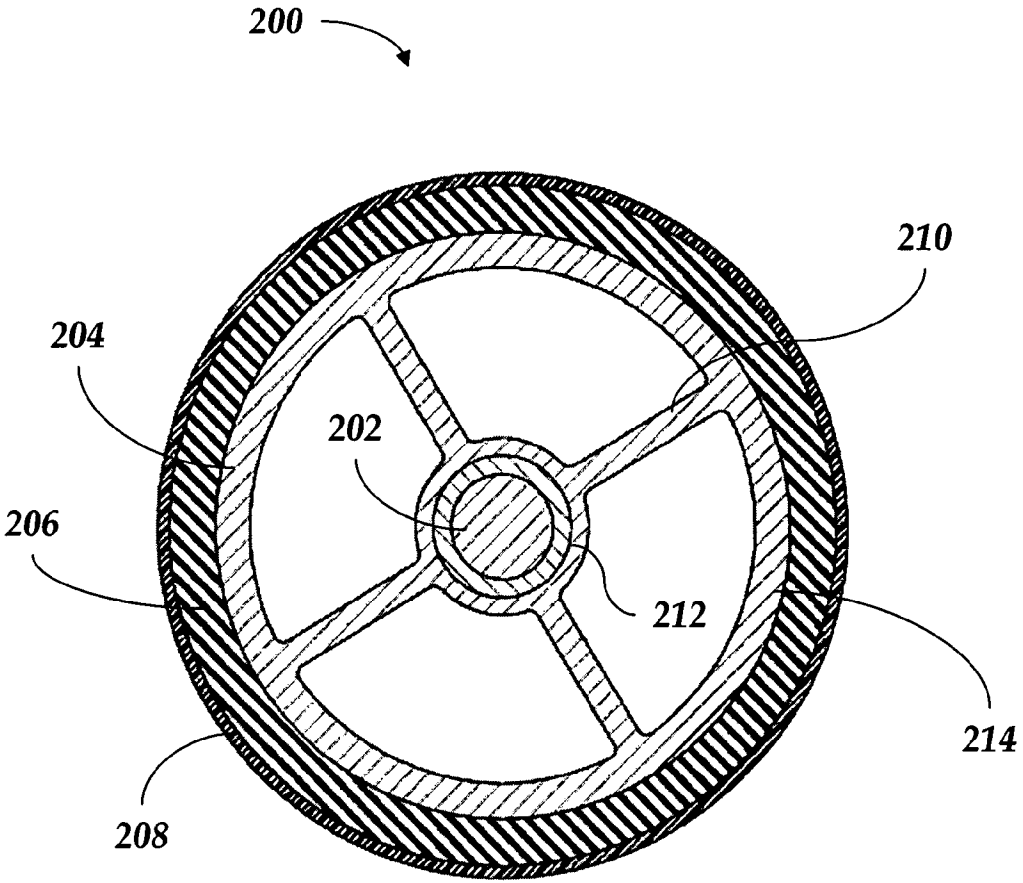
FIG. 3 is a cross sectional view of an illustration of an exemplary embodiment of a component.

The exemplary roller 200, illustrated in FIGS. 2 and 3, may include a number of portions. For example, the roller 200 may include a shaft 202 and a core 204. The core 204 may be engaged to the shaft 202 and to outer layer 206. The core 204 therefore may be positioned between the shaft 202 and outer layer 206 and as discussed more fully herein, may now be made from a non-metal material, such as a polymeric material. The core may completely surround the shaft 202. Furthermore, a layer of release material 208 may be disposed on a portion of the layer 206. The core 204 may be placed over the shaft 202 using a number of methods. For example, the core 204 may be molded and assembled with the shaft 202. The core 204 may also be overmolded onto the shaft 202 via extrusion or injection molding.

The core 204 may also specifically include a relatively cylindrical geometry engaging the shaft and may also be solid or hollow. As illustrated in FIG. 3, a hollow core 204 may include one or more ribs 210 extending between an inner cylindrical body 212 and an outer cylindrical body 214. The two cylindrical bodies 212 and 214 may be concentric. The ribs 210 may extend the length of the core or may extend along potions of the core. The ribs 210 may also vary in thickness and geometry. The ribs 210 may also extend at various angles with respect to the longitudinal axis of the core (illustrated by phantom lines A in FIG. 2). That is, the rib may adopt a spiral configuration as it engages along the length of the core.

The component, such as a roller 200 herein, is one that may now advantageously reduce power consumption by the heating device 101. This may therefore be accomplished by use of a roller that provides a relatively low overall thermal response. For example, a roller that when used with heating device 101 leads to the overall use of relatively less energy to transition to a desired temperature, such as a desired operating temperature, warm-up temperature, stand-by temperature, etc. The component may therefore utilize materials that have a relatively low thermal conductivity.

It may now be appreciated that the thermal response of the exemplary component (roller 200) and the energy required to transition the roller to a desired temperature, may depend upon a consideration of the thermal response of the materials that may be utilized for each portion or section of the roller. For example, the shaft, core, etc., as noted above. To determine thermal response, one may first consider the thermal mass TM of each portion of the roller present, which may be understood by the following relationship:

$$TM=\rho\times V,$$

wherein ρ is the density (g/cc) of the material at issue and V is volume (cc) occupied by such material. The thermal response TR (Joules/$^{o}$K) of the thermal mass present may then be defined by the product of thermal mass and the specific heat capacity Cp (J/g-K) for the material, and may be provided by the following:

$$TR=TM\times Cp=[\rho\times V]\times Cp$$

A combined thermal response may also therefore be determined which may correspond to the sum of the thermal response of those portions of the roller at issue. For example, for a roller that has a base construction that includes a metal shaft and a non-metal component engaged to the shaft, the thermal response of such base construction would consider the sum of the thermal responses of the metal shaft and non-metal component according to the above relationships. For example, the metal shaft may have a thermal response ($TR_{metal}$) and the non-metal core component engaged with the shaft may have a thermal response ($TR_{non\text{-}metal}$). Accordingly, the thermal response of the shaft and core would be the combination of these two identified values.

It may also be appreciated that one may now also consider and characterize the thermal behavior of the materials within a roller at issue with respect to the value of volumetric heat capacity ($Cp_v$). More precisely, this is the amount of energy that may be required to change a unit volume of the material employed (e.g., in either the shaft and/or core) by a unit of temperature. The volumetric heat capacity, expressed in units of J/cc-K, may therefore be provided by the following:

$$Cp_v=Cp\times\rho$$

To next determine the energy required $E_{required}$ (Joules) to adjust the temperature of each portion of the roller, one may consider the product of the thermal response and the change in temperature experience by the component. Thus, the energy required may be expressed as follow:

$$E_{required}=TR\times\Delta T=\rho\times V\times Cp\times\Delta T,$$

wherein ΔT is the change in temperature. The temperature change experienced by the component may be, for example, the difference between a desired operating temperature and room temperature or a change from, e.g., a programmed warm-up temperature or a standby temperature within an image forming apparatus.

Table I below now provides some representative values for an exemplary roller engaged to a fuser in an image forming apparatus:

TABLE I

| Material | Cp (J/g-K) | Thermal Conductivity (W/m-K) | Density (g/cc) | Volume (cc) | Thermal Mass (g) | $Cp_v$ (J/cc-K) | Thermal Response (J/K) |
|---|---|---|---|---|---|---|---|
| All Aluminum Roller Shaft & Core | 0.897 | 180 | 2.7 | 56 | 151.2 | 2.42 | 135.63 |
| Iron/Steel Shaft | 0.449 | 70 | 7.87 | 12.7 | 99.9 | 3.53 | 44.88 |
| Polymer Composite Roller Core | 0.80 | 0.15 | 1.4 | 43.0 | 60.2 | 1.12 | 48.16 |

As can be seen from the above, the thermal response of an all aluminum roller shaft and core at a given volume of about 56 cc is 135.63 J/K. By comparison, the thermal response of the non-metal polymer or polymer based composite core at a volume of about 43 cc, is 48.16 J/K, and the thermal response of 12.7 cc of an iron/steel shaft that may be used with the non-metal core is 44.88 J/K. Therefore, collectively considering the thermal response of the iron/steel shaft and non-metal core provides a value of 93.04 J/K. Accordingly, it can be observed that an all aluminum roller shaft and core at a given volume of about 56 cc indicates a thermal response of 135.63 J/K. However, an iron/steel shaft in combination with a non-metallic core at a comparable and substantially equal volume of 55.7 cc (wherein the majority of such volume is accounted for by the non-metallic core) leads to a thermal response of 93.04 J/K. Accordingly, this is about 42.59 J/K lower, which roller, when employed as a back-up roller in conjunction with a fuser, provides improved thermal response and may utilize relatively less fuser power.

Therefore, in the broad context of the present invention, a component is provided that is capable of engaging a heating source in an image forming apparatus, that includes a first metallic material having a thermal response ($TR_1$) and a second non-metallic material having a thermal response ($TR_2$), wherein the total thermal response is less than or equal to about 130 J/K, including all values and increments therein. In addition, the thermal mass of the non-metal component may be selected so that it is lower than the thermal mass of a selected metal component.

In addition, it can be seen from the Table I that with respect to the exemplary back-up roller, the volumetric heat capacity ($Cp_v$) of the core 204 which may be in contacting relationship with layer 206 is about 1.12 J/cc-K. In the broad context of the present invention, such core may have values of equal to or less than about 2.00 J/cc-K, including all values and increments therein. Furthermore, as can be seen, the core may be engaged with a shaft 202 that has a volumetric heat capacity that is greater than the volumetric heat capacity of the core, and which may have a value of equal to or less than about 4.0 J/cc-K, including all values and increments therein.

Moreover, the shaft portion 202 of the exemplary roller may itself have a thermal response (TR) of less than or equal to about 75 J/K, including all values and ranges therein. The shaft 202 may include steel, aluminum, copper, alloys, etc. The shaft 202 may also have a thermal conductivity of equal to or less than about 180 W/m-K including all values and ranges therein. The shaft may also have a heat capacity (Cp) of equal to or less than about 1.0 J/g-K including all values and increments therein. The shaft 202 may include a cylindrical geometry that may be either solid or hollow. Furthermore, the shaft 202 may have a thermal mass of equal to or less than about 200 grams, including all values and increments therein. The length of the shaft 202 may generally be between about 10 to 35 cm including all values or increments therein. The total diameter of the shaft (including all layers) may be about 15-50 mm. The shaft 202 may be, for example, extruded or formed via other means such as molding, machining, etc.

The core itself 204 may have a thermal response (TR) of less than or equal to about 75 J/K, including all values and increments therein. As noted above, the core may include a polymeric material such as a thermoplastic material, e.g. polyethylene terephthalate (PET) provided by DuPont Engineering Polymers under the trademark Rynite®. The core may also include syndiotactic polystyrene (SPS), polyamides (nylons) having a Cp of about 1.6 J/g-K, polystyrene based polymer having a Cp of about 1.2-2.1 J/g-K, polycarbonate having a Cp of about 1.0-1.2 J/g-K, polyetheretherketones (PEEK) having a Cp of about 2.16 J/g-K, polyphenylene sulfide, etc. The material used in the core may therefore have a specific heat capacity of equal to or less than about 2.5 J/g-K, including all values and increments therein. The material in the core may also have a thermal conductivity of equal to or less than about 5 W/m-K, including all values and increments therein. Furthermore, the core may have a thermal mass of less than about 100 grams, such as 75 grams, 60 grams, etc. Polymer based compounds for the core may be reinforced with inorganic fibers, flakes and/or other types of mechanical reinforcements.

The layer of polymeric material 206 that may circumscribe the core 204 may include a rubbery or elastomeric material, e.g. silicone rubber, rubber, etc. The polymeric material 206 may have a specific heat capacity of between 0.1 J/g-K to 2 J/g-K and any increment or value therebetween including 1.2 J/g-K, 1.3 J/g-K, 1.4 J/g-K, etc. The polymeric material 206 may also have a thermal conductivity of between about 0.1-3 W/m-K. The polymeric material 206 utilized in an exemplary roller may have a volume of between about 30-50 cc and may therefore have a thermal mass of equal to or less than about 100 J/K, including all values and increments therein.

The polymeric material 206 may be less than or about 5 mm in thickness, e.g. 5 mm, 4 mm, 3 mm, etc. The polymeric material 206 may be formed via a number of methods. The polymeric material 206 may be formed via extrusion or injection molding and assembled over the core 204. The polymeric material 206 may also be overmolded onto the core 204 via injection molding, extrusion or another processing method.

The layer of release material 208 may include a sleeve or a layer of coated or sprayed material disposed on the polymeric material 206. The release layer 208 may be composed of polytetrafluoroethylene (PTFE), perfluoroalkoxy-tetrafluroethylene (TEFLON®-PFA), fluorinated ethylene propylene (FEP), fluoroelastomers, other fluoropolymers and combinations, copolymers or blends thereof. The release layer 208 may have a thermal response of equal to or less than 10 J/K, including all values and ranges therein. The release layer 208 may also have a heat capacity of less than or equal to about 2.0 J/g-K, including all values and ranges therein. The release layer 208 may also have a thermal conductivity of less than or equal to about 1.0 W/m-K, including all values and ranges therein. Furthermore, the release layer 208 may be present at a volume of equal to or less than about 5.0 cc, and provide a thermal mass of equal to or less than about 10 grams.

In addition to the above, it has been found that the power to develop a temperature rise in the component herein with a designed thermal response may also provide a power reduction in the associated heating component, for example a fuser component engaged in a contacting relationship to the exemplary roller component. For example, in the case of an alumina heater fuser set to a temperature of about 170° C., the following may be observed:

TABLE II

| Material | Energy To Temperature Rise Of 75° C. (J) | Time To Temperature Rise (sec) | Thermal Response (J/K) | Power To Temperature Rise (W)[1] |
|---|---|---|---|---|
| All Aluminum BUR Shaft & Core | 10172 | 5.6 | 135.63 | 1816 |
| Iron/Steel Shaft | 3366 | 5.6 | 44.88 | 601 |
| SPS BUR Core | 3612 | 5.6 | 48.16 | 645 |

[1]Power To Temperature Rise = (Thermal Response J/K) × (Temperature Rise of 75° C.)/(Time To Temperature Rise Of 5.6 sec).

The foregoing description is provided to illustrate and explain the present invention. However, the description hereinabove should not be considered to limit the scope of the invention set forth in the claims appended here to.

What is claimed is:

1. A component directly engaging a heating source in an image forming apparatus comprising a shaft comprising a metallic material having a thermal response ($TR_1$) and a core coupled to said shaft comprising a plurality of ribs extending generally radially outwardly from said shaft and defining a plurality of hollow areas between said plurality of ribs, said core comprising a non-metallic material having a thermal response ($TR_2$), wherein $TR_1+TR_2$ is less than or equal to about 130 J/K.

2. A component according to claim 1 wherein said component is a roller and said heating source is a fuser.

3. A component according to claim 1 wherein said metallic component has a thermal response of equal to or less than about 75 J/K.

4. A component according to claim 1 wherein said non-metallic component of equal to or less than about 75 J/K.

5. A component according to claim 1 wherein said metallic material and non-metallic material have a thermal mass, and said thermal mass of said non-metallic material is less than said thermal mass of said metallic material.

6. A component according to claim 1 wherein said non-metallic material comprises a polymeric material.

7. A component according to claim 1 wherein said non-metallic material has a volumetric heat capacity of equal to or less than about 2.0 J/cc-K.

8. A component according to claim 1 located within a printer cartridge.

9. A component according to claim 1 located within an image forming apparatus.

10. A component according to claim 1 wherein said core has a thermal conductivity of less than about 5 W/m-K.

11. A component according to claim 1 wherein said metallic material has a thermal mass of equal to or less than about 200 grams.

12. A component according to claim 1 wherein said core has a thermal mass of less than about 100 grams.

13. A component according to claim 1 further comprising a layer of polymeric material circumscribing said core.

14. A component according to claim 13 further comprising a release layer disposed on said layer of polymeric material.

15. A component according to claim 1 wherein the volumetric heat capacity of the metal component is greater than the volumetric heat capacity of the non-metal component.

16. A component according to claim 1 wherein said core further comprises an inner cylindrical body and an outer cylindrical body, and wherein said plurality of ribs extend between said inner and said outer cylindrical bodies.

17. A roller directly engaging a fuser in an image forming apparatus wherein said roller comprises a metallic shaft having a thermal response ($TR_1$) and a non-metallic core coupled to said shaft comprising a plurality of ribs extending generally radially outwardly from said shaft and defining a plurality of hollow areas between said plurality of ribs, said core having a thermal response ($TR_2$) wherein $TR_1+TR_2$ is less than or equal to about 130 J/K.

18. The roller of claim 17 wherein said metallic shaft and non-metallic core have a thermal mass and said thermal mass of said non-metallic material is less than said thermal mass of said metallic shaft.

19. The roller of claim 17 wherein said non-metallic material has a volumetric heat capacity of equal to or less than about 2.0 J/cc-K.

20. The roller of claim 17 located within a printer cartridge.

21. The roller of claim 17 located within an image forming apparatus.

22. A component according to claim 16 wherein said plurality of hollow areas are disposed between said inner and said outer cylindrical bodies.

* * * * *